US005977714A

United States Patent [19]

Adamovski

[11] Patent Number: 5,977,714

[45] Date of Patent: Nov. 2, 1999

[54] MAGNETRON ANODES HAVING REFRACTORY MATERIAL AND COOLED BY FLUID BOILING

[76] Inventor: Victor Isaevich Adamovski, Wingate 15/31, Petah Tikvah, Israel

[21] Appl. No.: 08/834,400

[22] Filed: Apr. 16, 1997

[51] Int. Cl.[6] ..... H01J 23/02; H01J 25/50

[52] U.S. Cl. ..... 315/39.75; 315/39.75; 313/35; 313/36

[58] Field of Search ..... 315/39.75, 39.65, 315/39.51; 313/35, 36; 165/104.33

[56] References Cited

U.S. PATENT DOCUMENTS

| | | | |
|---|---|---|---|
| 2,615,143 | 10/1952 | Broun | 315/39.75 X |
| 3,255,813 | 6/1966 | Besson et al. | 165/104.33 X |
| 3,280,897 | 10/1966 | Beurtheret | 313/36 X |
| 3,289,022 | 11/1966 | Oberläder | 165/104.33 X |
| 3,306,350 | 2/1967 | Beurtheret | 313/36 X |
| 3,612,932 | 10/1971 | Wilizek et al. | 315/39.63 X |
| 3,899,714 | 8/1975 | Esterson et al. | 315/39.63 X |
| 4,028,583 | 6/1977 | Bigham | 313/103 X |

*Primary Examiner*—Benny T. Lee
*Attorney, Agent, or Firm*—Mark M. Friedman

[57] ABSTRACT

A high-power, fluid-cooled magnetron. Hollow anode members surrounding a central cathode are provided with a trapezoidal cross section. The anterior and lateral surfaces of each anode member are covered with a thermally insulating layer, which in turn is covered with a refractory metal shield. When plasma electrodes strike and heat the anode members, heat is conducted uniformly into the interior of the anode members and dissipated by natural convection of a cooling fluid that circulates through the anode members.

9 Claims, 10 Drawing Sheets

MAGNETRON ANODES HAVING REFRACTORY MATERIAL AND COOLED BY FLUID BOILING

FIELD AND BACKGROUND OF THE INVENTION

The present invention relates to magnetrons and, more particularly, to a high power magnetron cooled by boiling at natural convection.

Magnetron generators and intensifiers are widely used to generate microwaves, for example in microwave ovens and in radar systems. Generally, only low power, air cooled magnetrons are used. These have powers up to about 3 kW and efficiencies as high as 60%–75%.

Higher power magnetrons must be cooled by the forced circulation of a cooling liquid through their anodes and cathodes. As a result, their efficiencies do not exceed 28%–30%, making them too inefficient for many otherwise desirable applications in chemical engineering, food processing, drying, disinfection of agricultural produce, etc. For example, the combined heating of wood by microwave radiation (heating the wood internally) plus hot gas or air (heating the wood externally) would reduce the drying time of green wood by many orders of magnitude and substantially decrease the total energy consumption.

The anodes of prior art magnetrons are of two types, rods and lamellae. Both types of anodes are used in low power, air cooled magnetrons. Only tubular rods are used as anodes in high power, liquid cooled magnetrons because of the difficulty associated with dissipating heat flux through lamellae. The tubular anodes used in liquid cooled magnetrons are hollow tubes of circular or rectangular cross section. These anodes experience intense heating during the operation of these magnetrons, because of bombardment by electrons emitted by the cathode, accelerated by the potential difference between the cathode and the anodes, and focused onto the zone of interaction by the magnetic field. Any nonuniformity in the flow of cooling liquid through the anodes and cathodes would lead to nonuniform heat transfer and damage to the anodes or cathodes. To make sure that the circulation of cooling liquid through the anodes and cathodes is uniform, powerful pumps and complex automatic control systems are necessary. Because the anode voltage is high (10 kV to 50 kV) and the supply voltage of the pumps is typically 220 V or 380 V, high-voltage plastic insulation is used to isolate the pumps electrically from the anodes and cathodes. These plastics generally are not heat resistant, and break down at temperatures above about 80° C. The temperature of the coolant therefore must be kept below about 80° C., with a consequent reduction in the thermodynamic efficiency of the cooling. Because ambient temperatures may be as high as about 50° C., the heat exchangers of these cooling systems must be designed with large areas, to accommodate a temperature difference between the coolant and the surroundings of only 25° C. to 30° C.

There is thus a widely recognized need for, and it would be highly advantageous to have, a high-power liquid-cooled magnetron at least as efficient as known low-power air-cooled magnetrons. Preferably, the magnetron would require only built-in low-power pumps, or would rely exclusively on boiling at natural convection, thus not requiring pumps at all.

SUMMARY OF THE INVENTION

According to the present invention there is provided a magnetron including: (a) a cathode; (b) a plurality of hollow anode members surrounding the cathode, each of the anode members including an anterior surface and two lateral surfaces, the surfaces defining among them a cross section; and (c) a cooling fluid within the anode members, the cross section being large enough to allow boiling at natural convection of the cooling fluid during operation of the magnetron.

According to the present invention there is provided a method of cooling a magnetron of the type in which a central cathode is surrounded by a plurality of hollow anode members, including the steps of: (a) providing a cooling fluid substantially filling the anode members, the cooling fluid being heated and at least partially vaporized during operation of the magnetron; and (b) orienting the magnetron so that the cooling fluid circulates through the anode members by boiling at natural convection.

According to the present invention there is provided a method of increasing the efficiency of a magnetron of the type in which a central cathode is surrounded by a plurality of anode members, including the steps of: (a) providing each of the anode members with a refractory shield facing the cathode, the refractory shield being insulated electrically from the anode member; and (b) establishing an electron cloud adjacent to each of the shields by electrostatic focusing.

The anodes of the present invention are fully or partially tubular, and substantially trapezoidal in cross section, with the short base of the trapezoid being the anterior side of the anode that faces the cathode. The sides of the trapezoid point radially away from the cathode. The anterior side of each anode, and also at least part of the lateral sides of each anode, that correspond to the sides of the trapezoid, are covered by a shield of a refractory metal such as tungsten. Such shields are known in the prior art; in the present invention, the shield is separated from the rest of the anode by a zone of low heat conductivity that may be either vacuum or a ceramic layer of low heat conductivity. In this way, the flow of heat from the shield to the body of the anode is retarded and spread out uniformly over the lateral sides of the anode, which have a significantly larger area than the anterior side of the anode and therefore can accommodate a much larger total heat flux without damage. The heat flux per unit area is much lower in magnetrons of the present invention than in prior art magnetrons, so the cooling liquid flow regime in magnetrons of the present invention is much less severe than a forced convection flow regime would be in prior art liquid-cooled magnetrons.

The magnetron is oriented so that the central cathode and the walls of the surrounding anodes are substantially vertical. Preferably, the cathode also is hollow and fluid-cooled. Heat entering the interior of the anodes through their anterior and lateral walls, and entering the cathode through its outer wall, causes the cooling liquid therein to boil, driving natural convection and circulating the cooling liquid through the anodes and the cathode without pumps. Because no pumps are used, the cooling system need not be insulated electrically from the anodes and from the cathode to the extent that is necessary in prior art systems, and the cooling fluid may be one (high pressure water/steam or alcohol) that boils at a temperature significantly higher than 80° C., with a consequent increase in the thermodynamic efficiency of the cooling. The magnetrons of the present invention typically operate at higher powers than similarly dimensioned prior art magnetrons, with cooling systems of 10%–20% of the size of the cooling systems of comparable prior art magnetrons. For example, a magnetron of the present invention, of essentially the same size and geometry as a prior art 50 kW magnetron, operates successfully at a power level of 125 kW.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is of a high-power fluid-cooled magnetron which can be used to generate microwave radiation much more efficiently than existing high power magnetrons.

The principles and operation of a magnetron according to the present invention may be better understood with reference to the drawings and the accompanying description.

Figure 1:
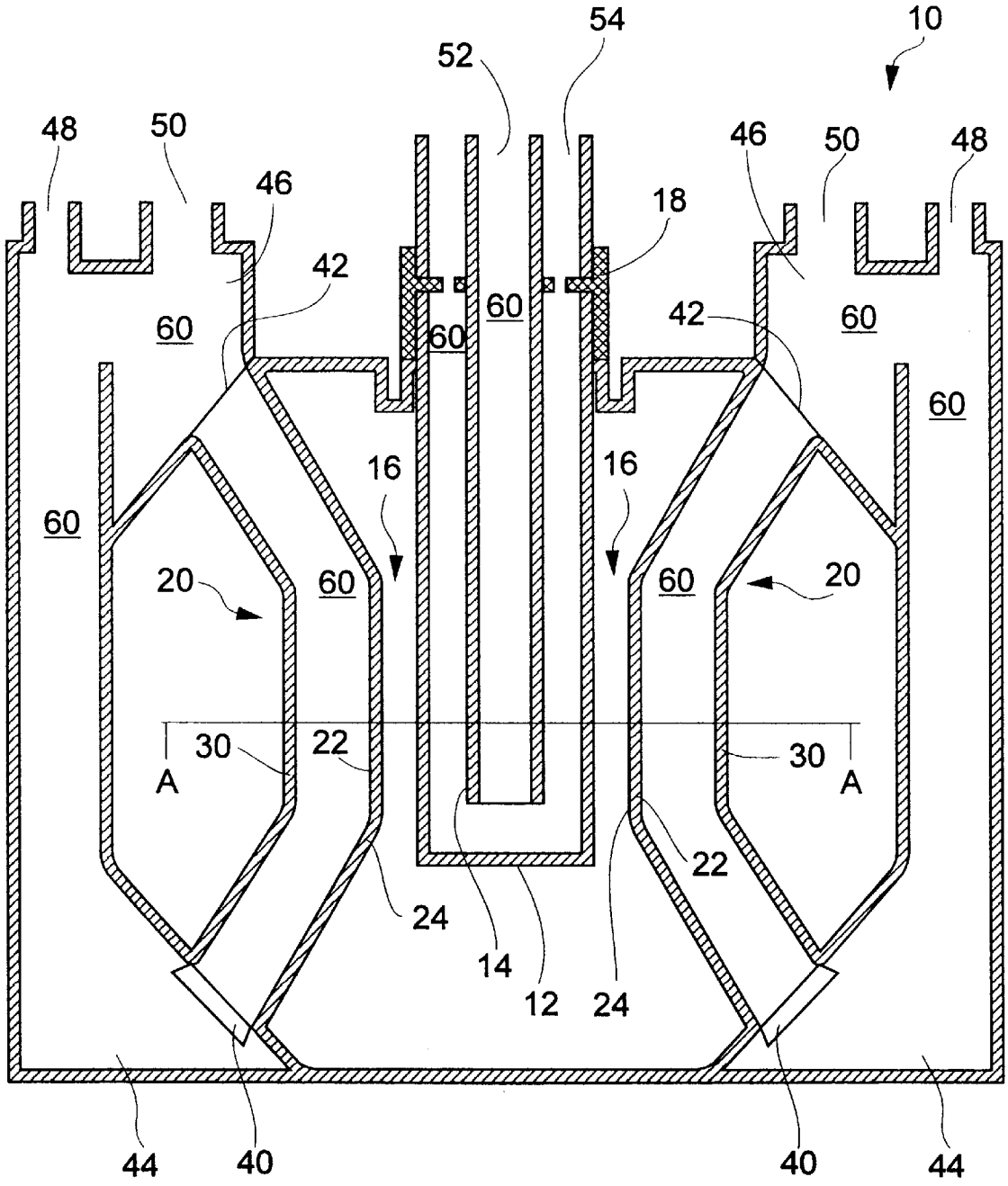
FIG. 1 is a partial vertical cross-section through a preferred embodiment of the magnetron of the present invention.
Figure 2:
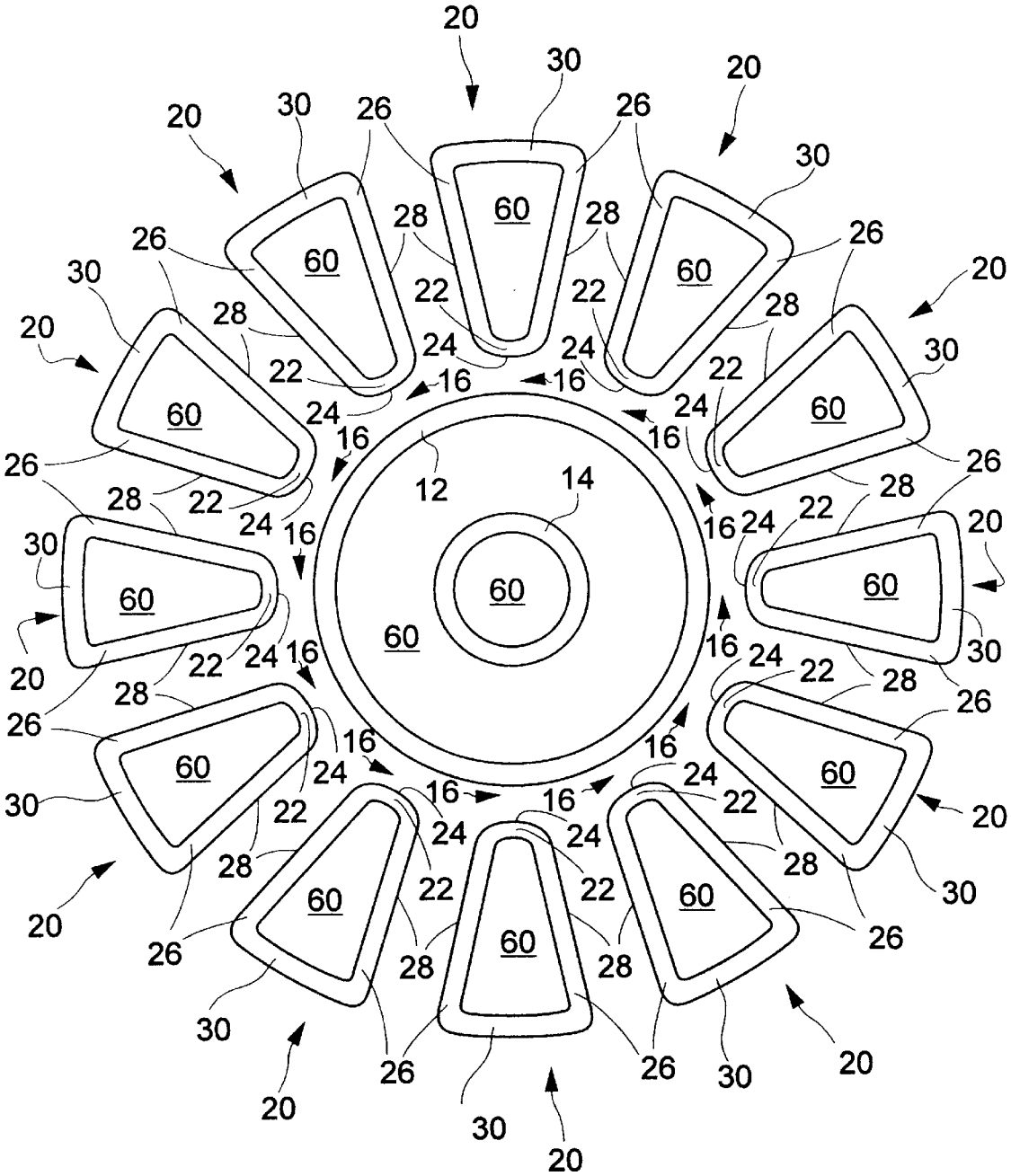
FIG. 2 is a partial horizontal cross-section through the magnetron of FIG. 1.

Referring now to the drawings, FIG. 1 is a partial vertical cross section through a first embodiment of a magnetron 10 according to the present invention. FIG. 2 is a partial horizontal cross section through magnetron 10 along cut A—A. FIG. 1 is partial in the sense that it omits magnetron components, such as the electromagnet, that are not germane to the present invention, but it is obvious to one ordinarily skilled in the art what is missing in FIG. 1 and how to incorporate it in a working magnetron.

Magnetron 10 includes a central cathode 12 mounted in an insulating base 18 and surrounded by twelve hollow anode members 20 (best seen in FIG. 2). Each anode member 20 includes a vertical anterior wall 22 having an anterior surface 24 that faces cathode 12 and two vertical lateral walls 26 having flat lateral surfaces 28 that extend radially away from anode member 20, so that each lateral surface 28 of one anode member 20 faces the other lateral surface 28 of a neighboring anode member 20 (best seen in FIG. 2). Cathode 12 and anterior surfaces 24 define between them an interaction zone 16: electrons emitted by cathode 12 and accelerated by the potential difference between cathode 12 and anode members 20 strike anode members 20 primarily on anterior surfaces 24.

Each anode member 20 also includes a posterior wall 30, so that each anode member 20 is a tube of substantially trapezoidal cross section, lateral walls 26 being substantially equal in length and posterior wall 30 being longer than anterior wall 22, so that facing lateral walls 26 of adjacent anode members 20 are substantially parallel. Thus, each anode member 20 is a tube, of substantially trapezoidal cross section, connected to an outer annular reservoir 44 by a vacuum tight seal at an inlet 40, and connected to an inner annular reservoir 46 by a vacuum tight seal at an outlet 42. Reservoirs 44 and 46 are filled with a cooling fluid 60. Cathode 12 also is filled with cooling fluid 60. The rest of the interior space of magnetron 10 is filled with vacuum. In normal operation, cold fluid 60 enters outer reservoir 44 from a condenser such as a heat exchanger (not shown) via inlet ports 48 and vapor of hot fluid 60 exits inner reservoir 46 to the condenser via outlet ports 50. Meanwhile, cold fluid 60 enters cathode 12 from the condensor via an inlet port 52 and a central inlet tube 14, and hot fluid 60 exits cathode 12 to the condensor via an annular outlet port 54 surrounding inlet port 52.

Figure 3A:
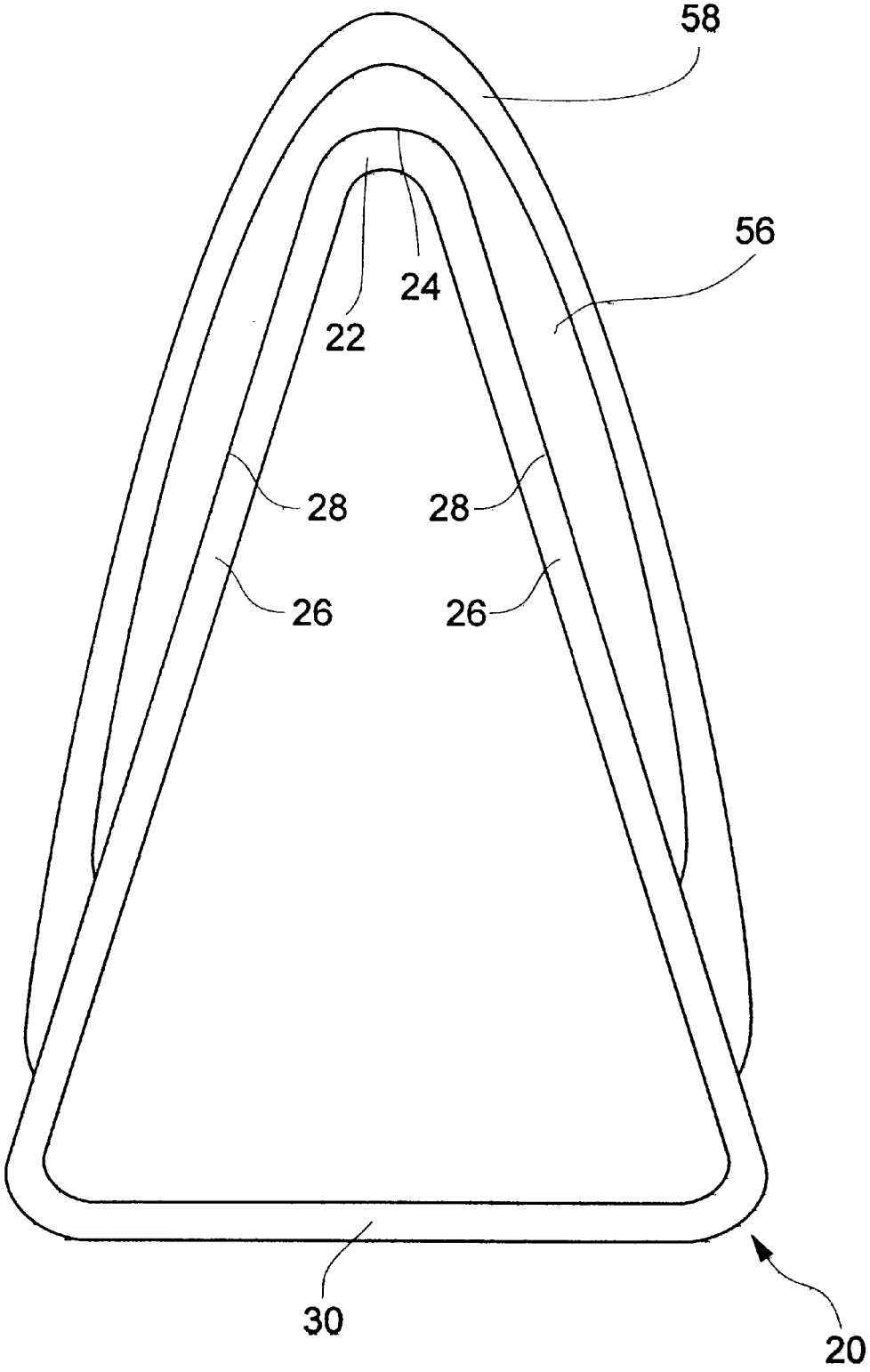
FIG. 3A is a horizontal cross-section through an anode member.
Figure 3B:
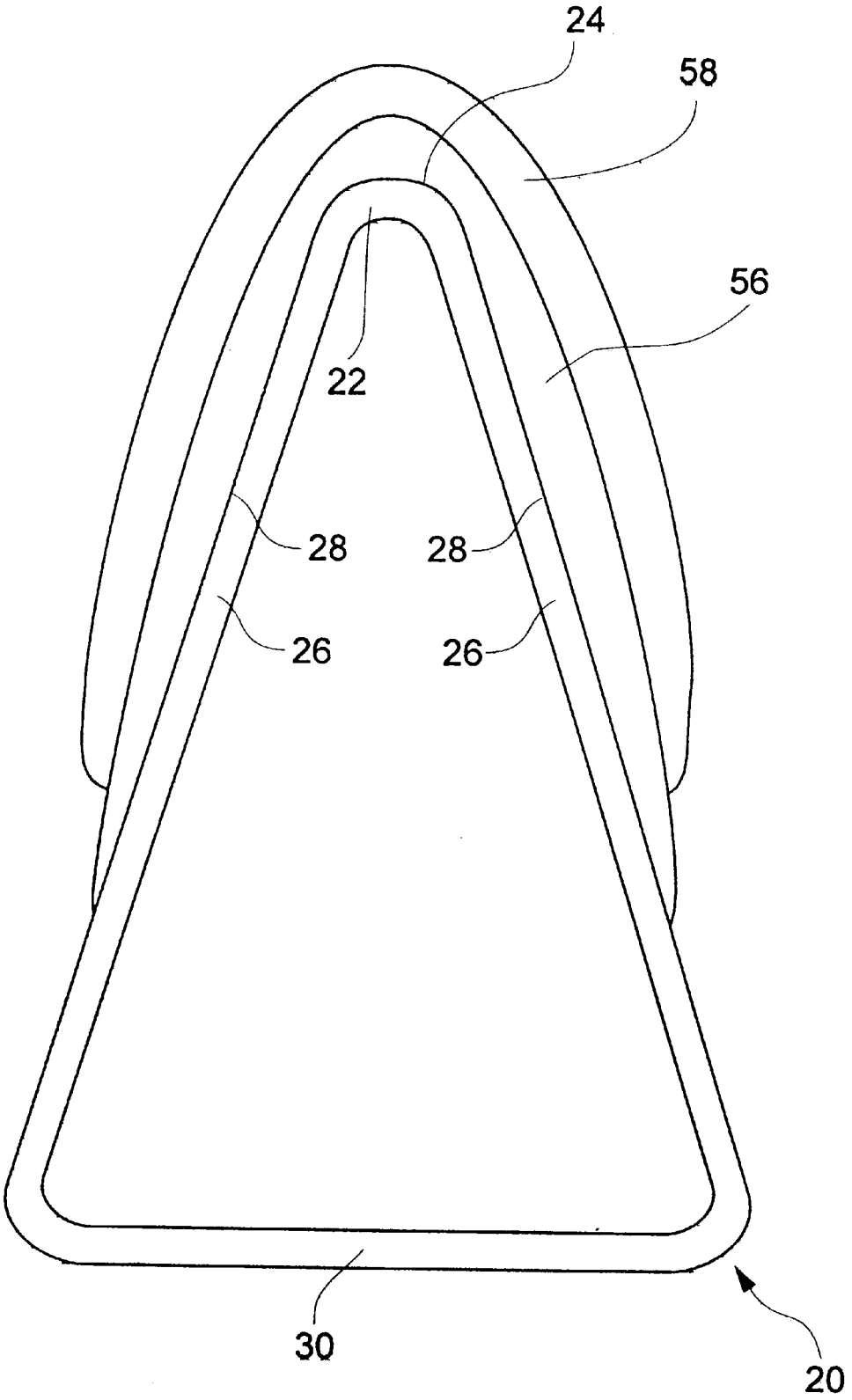
FIG. 3B is a horizontal cross-section through another embodiment of an anode member.

FIG. 3A is a horizontal cross section through an anode member 20 showing its construction in more detail. Walls 22, 26 and 30 are made of a highly electrically conductive metal, such as copper. Entirely covering anterior surface 24, and partially covering lateral surfaces 28, is a zone 56 of low heat conductivity. Zone 56 is in turn covered by a shield 58 made of a refractory metal such as tungsten. Zone 56 may be vacuum, or may be a layer of a ceramic of low heat conductivity. In the embodiment shown in FIG. 3A, shield 58 is in electrical contact with lateral surfaces 28. FIG. 3B shows an alternative embodiment in which shield 58 is insulated electrically from anterior surface 24 and lateral surfaces 28 by zone 56. Note that if zone 56 in FIG. 3B is a ceramic layer, the ceramic must be electrically insulating as well as having a low heat conductivity. The advantage of the anode member construction shown in FIG. 3B is discussed below.

In operation, a static vertical magnetic field is imposed on interaction zone 16 and a high voltage difference is established between cathode 12 and anode members 20. Cathode 12 emits electrons that are accelerated in interaction zone 16 by the potential difference between cathode 12 and anode members 20 and are caused to strike shields 58, thereby heating shields 58. The dimensions and compositions of shields 58 and zones 56 are chosen so that this heat is distributed substantially uniformly over surfaces 24 and 28 and conducted thence into the interior of anode members 20; and so that the heat flux is substantially less than the corresponding heat flux in prior art magnetrons, and less by a factor of 10 to 20 than the heat flux associated with the impact of electrons on shields 58 in interaction zone 16.

Cooling fluid 60 is initially in an entirely liquid state. The heat flux entering anode members 20 heats cooling fluid 60, causing cooling fluid 60 to boil, setting up natural convection of a vapor-liquid mixture through anode members 20. When the volume fraction of vapor in the interiors of anode members 20 reaches between 0.1 and 0.3, forced natural convection begins, as liquid entrained by vapor bubbles also begins to circulate, typically at a velocity of 0.5 m/sec to 0.8 m/sec. The buoyancy of the vapor-liquid mixture in anode members 20 drives poloidal circulation of cooling fluid 60 through anode members 20 and reservoirs 44 and 46. Hot vapor rises from reservoir 46 into the condensor via ports 50, where the hot vapor is cooled and returned to reservoir 44 via ports 48 as a cold liquid. Hot liquid circulates directly from reservoir 46 to reservoir 44. The cooling system of the present invention, being based on natural convection, employs fewer moving parts than the cooling system of prior art high power magnetrons, and therefore is more reliable.

Meanwhile, electrons focused back onto cathode 12 strike and heat cathode 12. This heat also is removed from cathode 12 by the boiling of fluid 60: hot vapor rises from cathode 12 to the condensor via port 54 and condensed and cooled liquid reenters cathode 12 from the condensor via port 52 and inlet tube 14.

The cross-sectional dimensions of anode members 20 are chosen so that the portion of anode members 20 that project into interaction zone 16 are geometrically similar to the prior art anode members of circular cross section, while the remainder of each of anode members 20 is formed so that anode members 20 are large enough in cross section to allow unimpeded circulation of cooling fluid 60 by natural convection. The simplest overall cross-sectional shape of anode members 20 that satisfies these requirements is the generally trapezoidal shape illustrated in FIGS. 3A and 3B, with anterior wall 22 and anterior surface 24 rounded rather than flat; although the scope of the present invention includes anode members with flat anterior walls and anterior surfaces. Note that the limiting factor in the convective flow of fluid 60 through magnetron 10 is the cross-sectional area of anode members 20. Reservoirs 42 and 44 are much larger in cross sectional area than anode members 20, so the flow of fluid 60 through reservoirs 42 and 44 is essentially unimpeded.

Figure 3C:
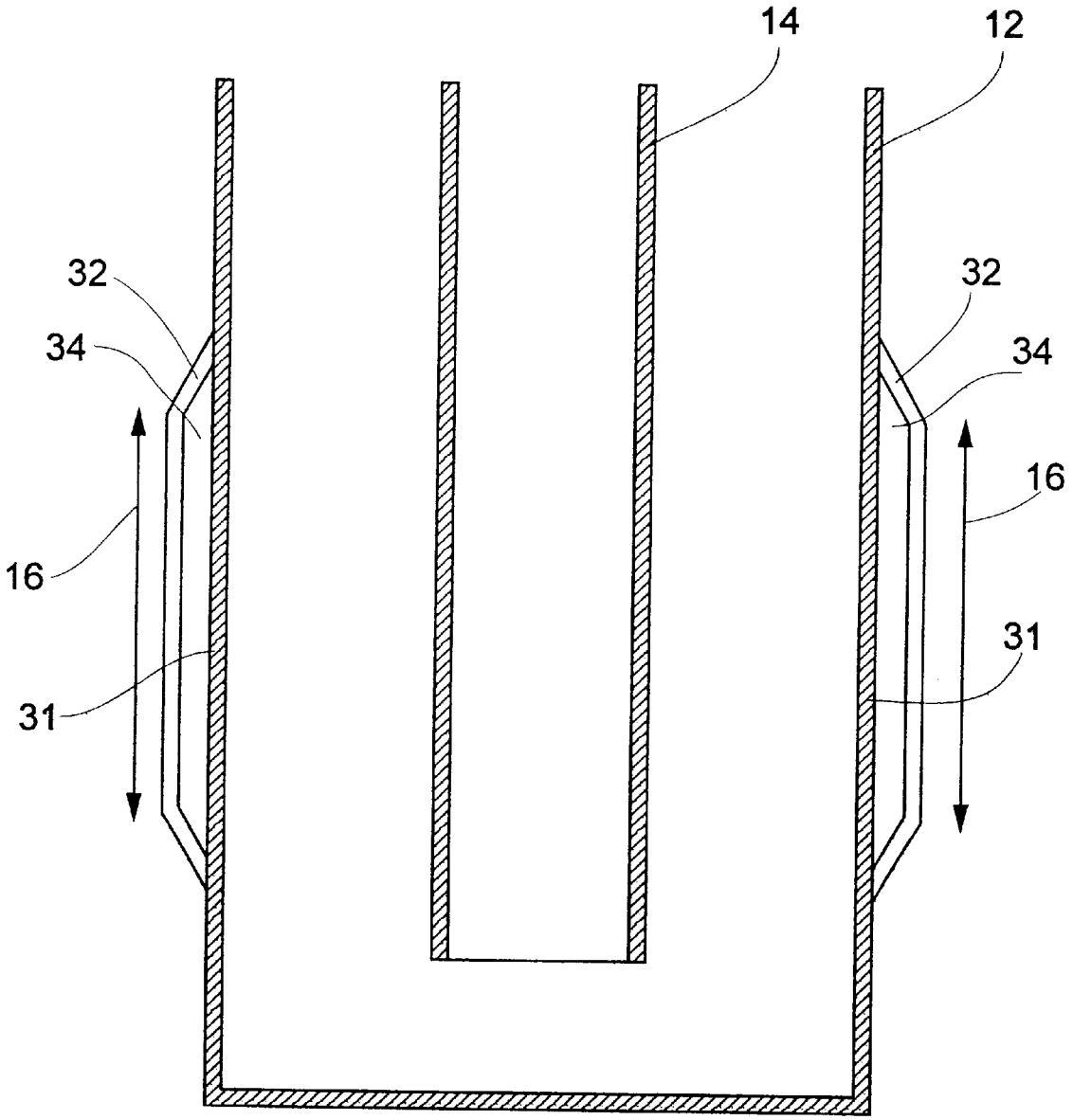
FIG. 3C is a vertical cross-section through the cathode.

Preferably, cathode 12 also is provided, in interaction zone 16, with a protective shield of a refractory metal such as tungsten, also separated from the body of cathode 12 by a zone of low heat conductivity. FIG. 3C shows the construction of cathode 12 in vertical cross section, showing the portion of outer surface 31 of cathode 12 that is opposite interaction zone 16 covered by a zone 34 of low heat conductivity, which is in turn covered by a shield 32. As in the case of shield 58, shield 32 is made of a refractory metal such as tungsten. As in the case of zone 56, zone 34 may be vacuum or ceramic. Note that shield 32 must be in electrical contact with the body of cathode 12 outside of interaction zone 16 in order for cathode 12 to function.

Figure 4:
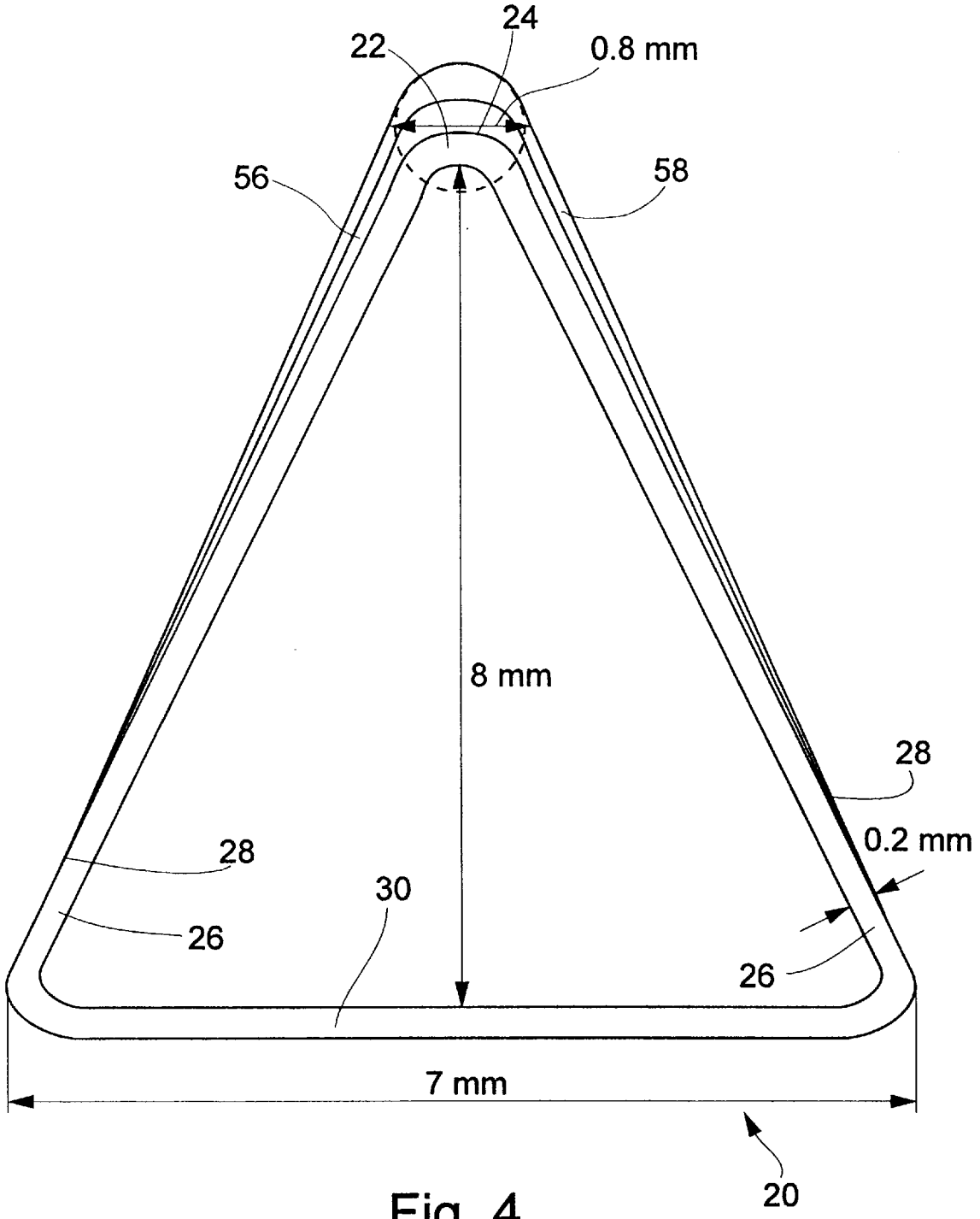
FIG. 4 is a horizontal cross-section through a specific example of an anode member.

FIG. 4 shows typical cross sectional dimensions of an anode member 20. The curvature of the outer surface of shield 58 is that of a circle of diameter 0.8 mm. The height of the channel is 8 mm, corresponding to a ratio of trapezoid height to trapezoid small base of 10:1. The preferred range of this parameter, the ratio of the trapezoid height to the length of the small base of the trapezoid, is between 5:1 and 25:1. The width of posterior wall 30 is 7 mm. The thickness of walls 22, 26 and 30 is 0.2 mm. The equivalent diameter (i.e., the diameter of an equivalent tube of circular cross section) of the channel is about 6 mm. Using water as cooling fluid 60 (see FIG. 1), with a volume fraction of steam of 10%–30% and in a permissible temperature regime, the heat flux into anode members 20 of this design may reach 400 $W/cm^2$. Under these conditions, cooling fluid 60 circulates through anode members 20 at speeds of between 0.5 m/sec and 0.8 m/sec, and the coefficient of boiling heat transfer is between 5 $W/cm^2/°C$. and 10 $W/cm^2/°C$.

Figure 5:
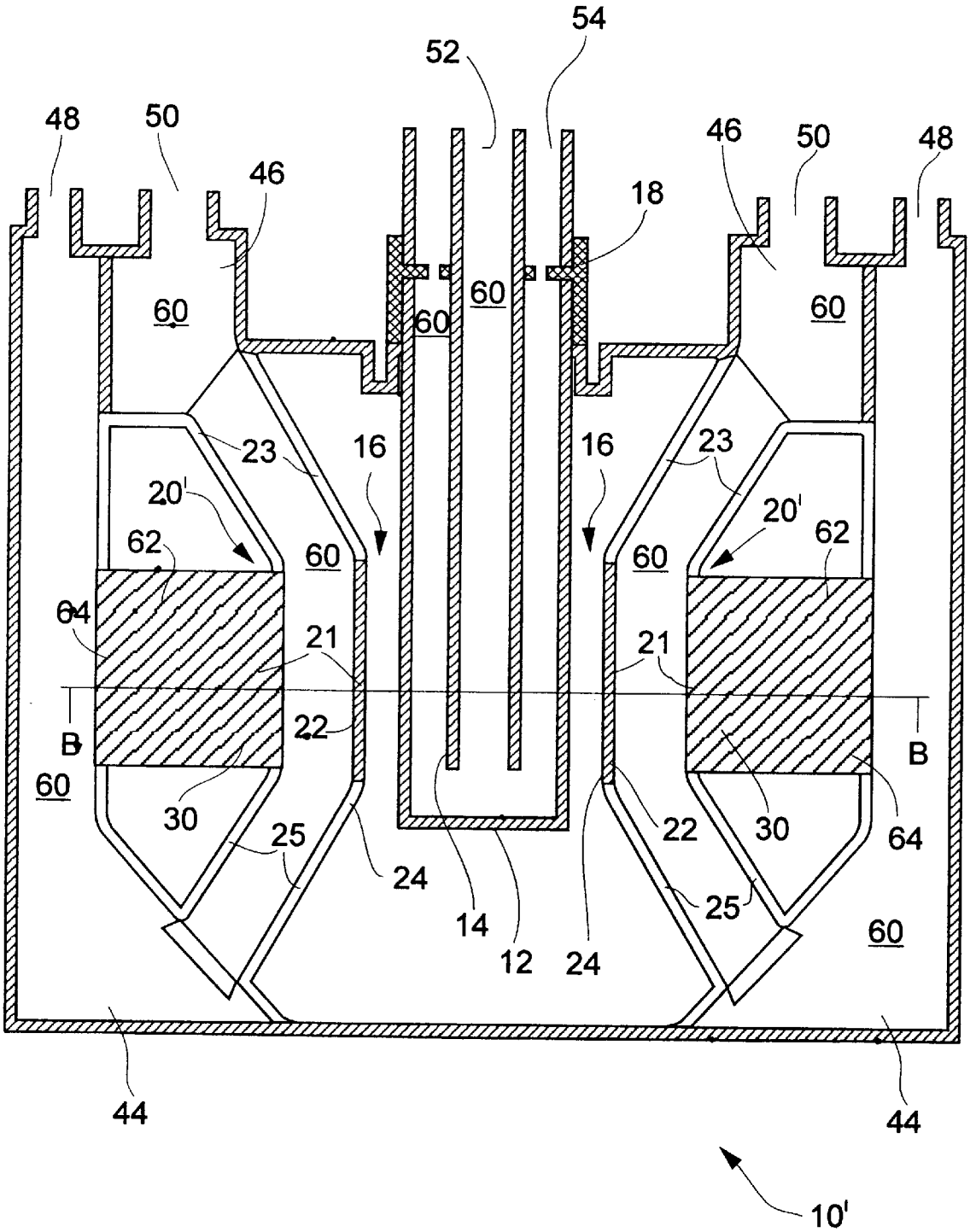
FIG. 5 is a partial vertical cross-section through a variant of the magnetron of FIG. 1.
Figure 6:
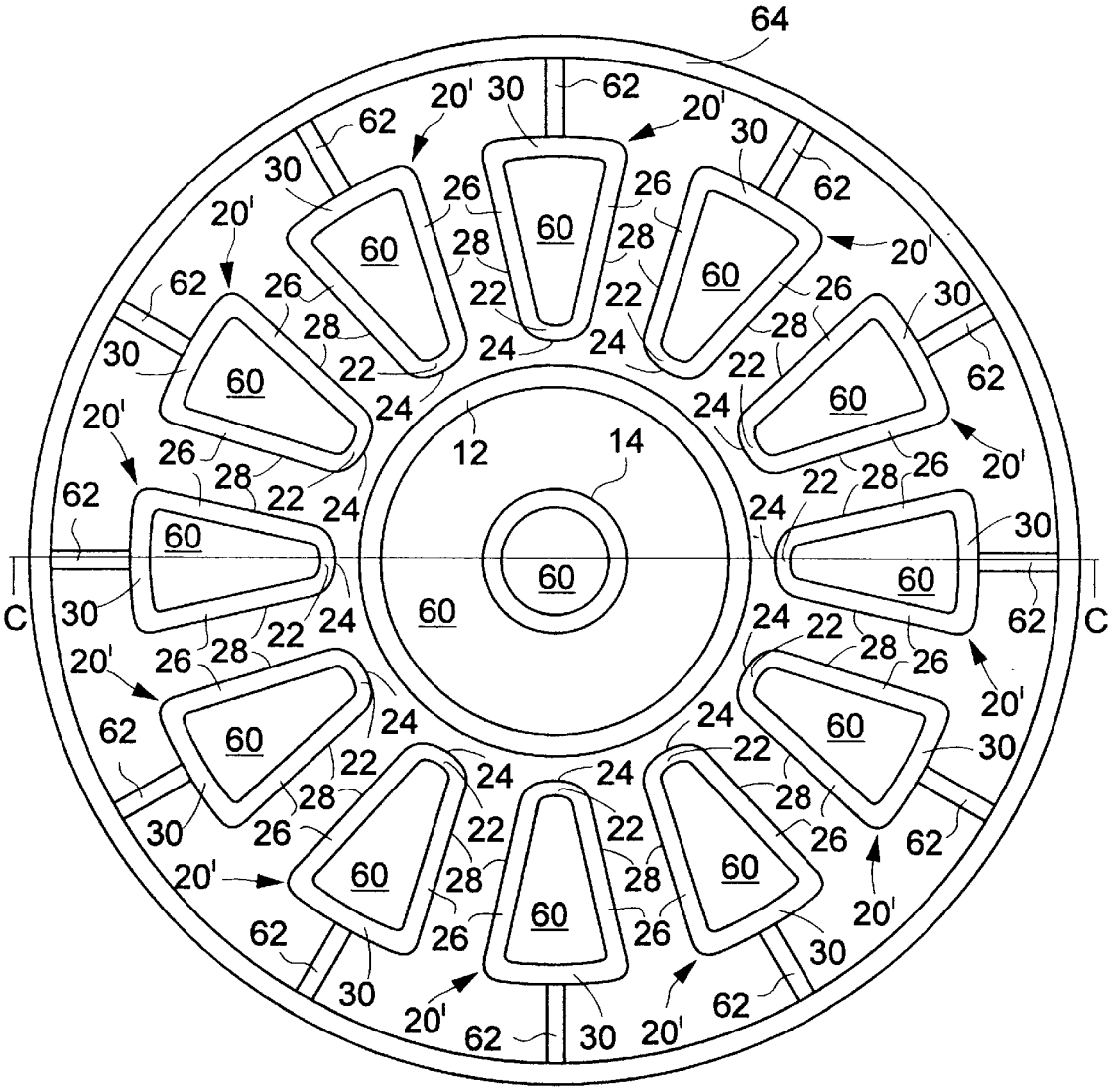
FIG. 6 is a partial horizontal-cross section through the magnetron of FIG. 5.

FIGS. 5 and 6 show a variant 10' of the magnetron of the present invention, in which anode members 20' are joined by electrically conducting radial lamellae 62 to a circumferential, electrically conducting ring 64. FIG. 5 is a partial vertical cross section through magnetron 10' along cut C—C, and FIG. 6 is a partial horizontal cross section of magnetron 10' along cut B—B. Only central portions 21 (see FIG. 5) of anode members 20', that connect to lamellae 62, are electrically conducting; upper portions 23, that connect to inner reservoir 46, and lower portions 25, that connect to outer reservoir 44, are electrically insulating. The construction of magnetron 10' is otherwise identical to the construction of magnetron 10. The anode of magnetron 10' is of mixed tubular-lamellar construction, combining tubular anode members 20' with lamellae 62 and ring 64. The operational difference between magnetrons 10 and 10' is that electrical current flows poloidally through the anode of magnetron 10 but toroidally through the anode of magnetron 10'.

Figure 7:
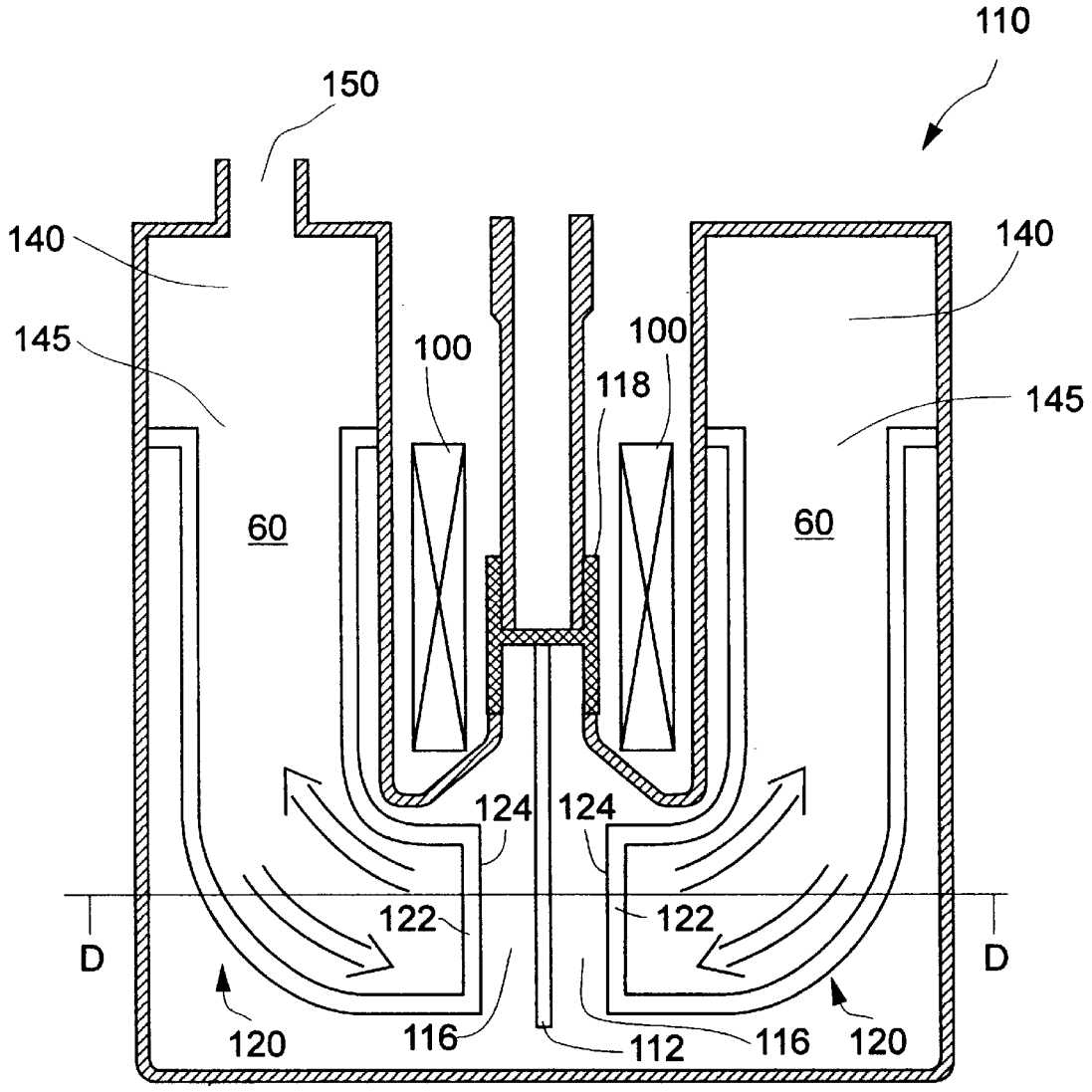
FIG. 7 is a partial vertical cross-section through a second preferred embodiment of a magnetron according to the present invention.
Figure 8:
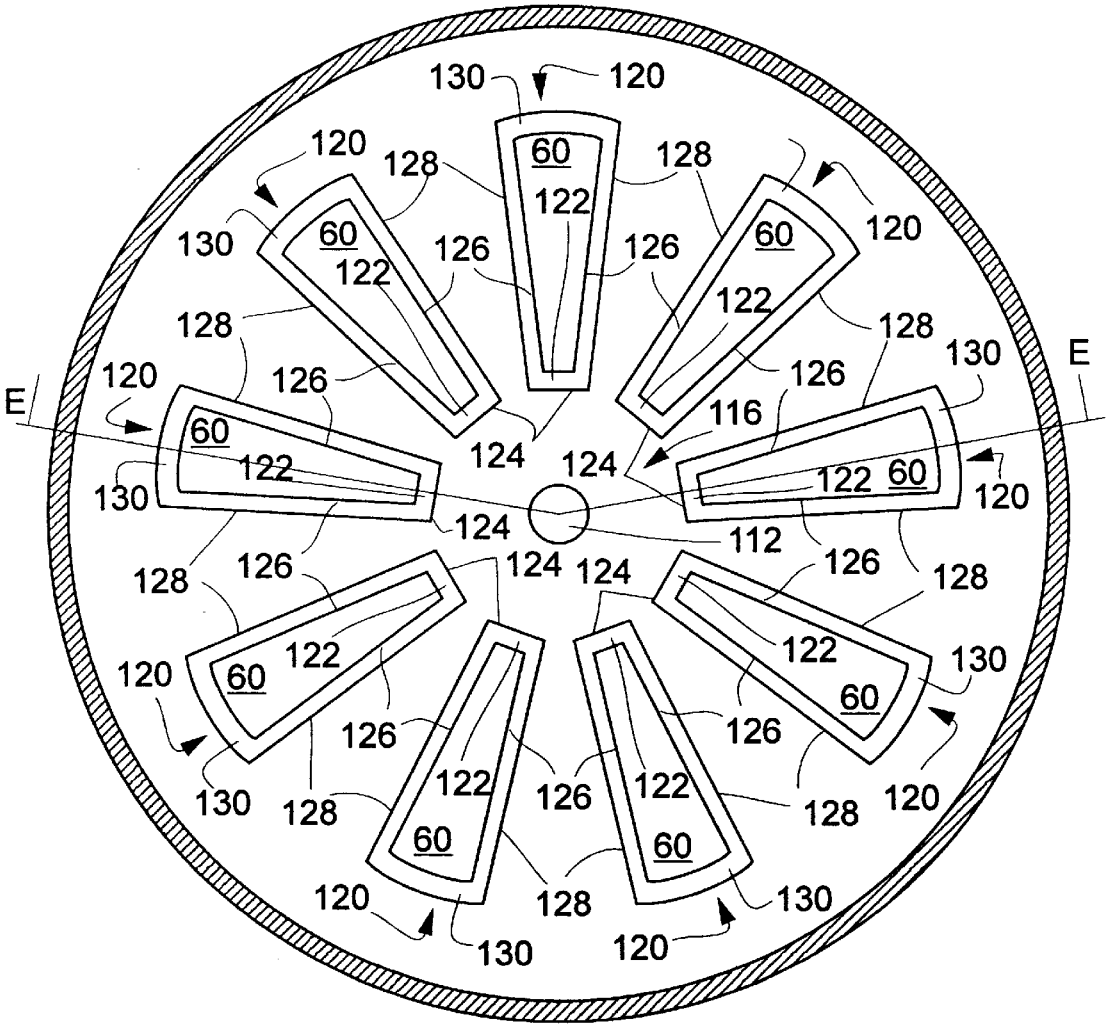
FIG. 8 is a horizontal cross-section through the magnetron of FIG. 7.

FIGS. 7 and 8 show a second embodiment 110 of a magnetron according to the present invention. FIG. 7 is a partial vertical cross-section along cut E—E. FIG. 8 is a horizontal cross-section along cut D—D. In magnetron 110, anode elements 120 are tubes of trapezoidal cross section in hydraulic communication, at openings 145, with a single reservoir 140. Anode elements 120 and reservoir 140 are filled with cooling fluid 60. Magnetron 110 also includes a central cathode 112, mounted in an insulating base 118 (see FIG. 7), and an electromagnet 100 see FIG. 7 for generating the magnetic field. As in the embodiment 10 of FIGS. 1 and 2, the portions of anode members 120 that surround cathode 112 in an interaction region 116 include anterior walls 122, lateral walls 126 and posterior walls 130. Also as in embodiment 10, outer surfaces 124 of anterior walls 122 and outer surfaces 128 of lateral walls 126 are covered, in and near interaction region 116, by zones of low heat conductivity that are in turn covered by refractive shields, as illustrated in FIGS. 3A and 3B.

In the operation of magnetron 110, the boiling of cooling fluid 60 near the inner surfaces of anterior walls 122 and lateral walls 126 sets up poloidal natural convective flow of cooling fluid 60, symbolized in FIG. 7 by the double arrows. Hot vapor rises from reservoir 140 via a port 150 to a condensor (not shown), where the vapor is condensed and cooled to a liquid state and returned to reservoir 140 via port 150 as seen in FIG. 7.

The anode member design illustrated in FIG. 3B provides an additional mechanism for inhibiting the transfer of heat from the electron beam in interaction region 16 to anode members 20. Because shield 58 is electrically insulated from walls 22 and 26 in this design, anode member 20 functions as a capacitor, with a region of negative charge building up on and around the outer surface of shield 58. The spreading of the heat flux from shield 58 over anterior surface 24 and lateral surfaces 28 according to the present invention allows anode member 20 of this design to support a temperature on shield 58 that is hot enough (2850° C. for tungsten) that shield 58 emits secondary electrons thermionically. Therefore, the region of negative charge on and around the outer surface of shield 58 includes both beam electrons that have impacted on shield 58 and secondary electrons emitted from shield 58, and takes the form of a surface charge on shield 58 and an electron cloud adjacent to shield 58. This region of negative charge provides electrostatic focusing of the electron beam in addition to the magnetic focusing provided by the magnetic field, and thus reduces the number of electrons that strike anode members 20, producing two beneficial effects. First, because the electrons emitted by cathode 12 and shields 58 tend to remain in interaction region 16 rather than leaving interaction region 16 via anode members 20, magnetron 10 or 10' has an efficiency of up to 85%, much higher than the maximum 30% efficiency of prior art liquid-cooled magnetrons. Second, the transfer of heat from the electron beam in interaction region 16 to anode members 20 is inhibited.

While the invention has been described with respect to a limited number of embodiments, it will be appreciated that many variations, modifications and other applications of the invention may be made.

What is claimed is:

1. A method of increasing the efficiency of a magnetron of the type in which a central cathode is surrounded by a plurality of anode members, comprising the steps of:

(a) providing each of the plurality of anode members with a respective refractory shield facing the cathode, said respective refractory shield being insulated electrically from said corresponding anode member; and (b) establishing a region of negative charge on and adjacent to each of said shields.

2. A magnetron comprising:

(a) a cathode;

(b) a plurality of hollow anode members surrounding said cathode, each of said anode members including a respective anterior surface and two corresponding lateral surfaces, said respective anterior and lateral surfaces defining among them a corresponding cross section, each of said anode members including a respective shield of a refractory metal covering at least part of said corresponding anterior surface and at least part of each of said corresponding lateral surfaces; and (c) a cooling fluid within said plurality of anode members, said respective cross section being large enough to allow boiling at natural convection of said cooling fluid as said anode members are heated during operation of the magnetron.

3. A magnetron comprising:

(a) a cathode;

(b) a plurality of hollow anode members surrounding said cathode, each of said anode members including a respective anterior surface and two corresponding lateral surfaces, said respective anterior and lateral surfaces defining among them a corresponding cross section substantially in a form of a trapezoid having a small base and height, said height being between 5 times and 7 times said small base; and (c) a cooling fluid within said plurality of anode members, said respective cross section being large enough to allow boiling at natural convection of said cooling fluid as said anode members are heated during operation of the magnetron.

4. The magnetron of claim 2, wherein said refractory metal includes tungsten.

5. The magnetron of claim 2, wherein each of said anode members includes a respective zone of low heat conductivity at least partly separating said respective shield from said corresponding surfaces.

6. The magnetron of claim 5, wherein said respective shield is insulated electrically from said corresponding lateral surfaces.

7. The magnetron of claim 5, wherein said respective zone of low heat conductivity includes a vacuum.

8. The magnetron of claim 5, wherein said respective zone of low heat conductivity includes a corresponding ceramic layer.

9. The magnetron of claim 5, wherein said respective shield is in electrical contact with said corresponding lateral surfaces.

* * * * *